US010070769B2

(12) United States Patent
Fountain et al.

(10) Patent No.: US 10,070,769 B2
(45) Date of Patent: Sep. 11, 2018

(54) ROTATING FILTER FOR A DISHWASHING MACHINE

(71) Applicant: WHIRLPOOL CORPORATION, Benton Harbor, MI (US)

(72) Inventors: Jordan R. Fountain, Millbrae, CA (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 146 days.

(21) Appl. No.: 15/017,708

(22) Filed: Feb. 8, 2016

(65) Prior Publication Data

US 2016/0150941 A1 Jun. 2, 2016

Related U.S. Application Data

(62) Division of application No. 13/164,066, filed on Jun. 20, 2011, now Pat. No. 9,265,401.

(51) Int. Cl.
*A47L 15/00* (2006.01)
*A47L 15/42* (2006.01)

(52) U.S. Cl.
CPC ..... *A47L 15/4202* (2013.01); *A47L 15/0002* (2013.01); *A47L 15/4206* (2013.01); *A47L 15/4208* (2013.01); *A47L 15/4219* (2013.01); *A47L 15/4225* (2013.01)

(58) Field of Classification Search
CPC ..... A47L 15/4202–15/4208
See application file for complete search history.

(56) References Cited

U.S. PATENT DOCUMENTS

| | | | |
|---|---|---|---|
| 7,896,977 | B2 | 4/1905 | Lehman |
| 1,617,021 | A | 2/1927 | Mitchell |
| 2,044,524 | A | 6/1936 | Charles |
| 2,154,559 | A | 4/1939 | Bilde |
| 2,422,022 | A | 6/1947 | Koertge |
| 2,734,122 | A | 2/1956 | Flannery |
| 3,016,147 | A | 1/1962 | Cobb et al. |
| 3,026,628 | A | 3/1962 | Berger, Sr. et al. |
| 3,068,877 | A | 12/1962 | Jacobs |
| 3,103,227 | A | 9/1963 | Long |
| 3,122,148 | A | 2/1964 | Alabaster |
| 3,186,417 | A | 6/1965 | Fay |
| 3,288,154 | A | 11/1966 | Jacobs |
| 3,542,594 | A | 11/1970 | Smith et al. |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

German Search Report for DE102013103625, dated Jul. 19, 2013.

(Continued)

*Primary Examiner* — Spencer E Bell
(74) *Attorney, Agent, or Firm* — McGarry Bair PC

(57) ABSTRACT

A dishwasher with a tub at least partially defining a washing chamber, a liquid spraying system, a liquid recirculation system defining a recirculation flow path, and a liquid filtering system. The liquid filtering system includes a rotating filter disposed in the recirculation flow path to filter the liquid.

7 Claims, 7 Drawing Sheets

(56) References Cited

U.S. PATENT DOCUMENTS 3,575,185 A 4/1971 Barbulesco
3,586,011 A 6/1971 Lamberto
3,708,120 A 1/1973 Camprubi et al.
3,739,145 A 6/1973 Woehler
3,801,280 A 4/1974 Shah et al.
3,846,321 A 11/1974 Strange
3,906,967 A 9/1975 Bergeson
3,989,054 A 11/1976 Mercer
4,179,307 A 12/1979 Cau et al.
4,180,095 A 12/1979 Woolley et al.
4,228,962 A * 10/1980 Dingier ..... A47L 15/4202 241/46.012
4,326,552 A 4/1982 Bleckmann
4,374,443 A 2/1983 Mosell
4,528,097 A 7/1985 Ward
4,754,770 A 7/1988 Fornasari
5,002,890 A 3/1991 Morrison
5,030,357 A 7/1991 Lowe
5,131,419 A 7/1992 Roberts
5,133,863 A 7/1992 Zander
5,331,986 A 7/1994 Lim et al.
5,454,298 A 10/1995 Lu
5,470,142 A 11/1995 Sargeant et al.
5,470,472 A 11/1995 Baird et al.
5,557,704 A 9/1996 Dennis et al.
5,569,383 A 10/1996 Vander Ark, Jr. et al.
5,618,424 A 4/1997 Nagaoka
5,655,556 A 8/1997 Guerrera et al.
5,711,325 A 1/1998 Kloss et al.
5,755,244 A 5/1998 Sargeant et al.
5,782,112 A 7/1998 White et al.
5,803,100 A 9/1998 Thies
5,865,997 A 2/1999 Isaacs
5,868,937 A 2/1999 Back et al.
5,904,163 A 5/1999 Inoue et al.
5,924,432 A 7/1999 Thies et al.
6,289,908 B1 9/2001 Kelsey
6,389,908 B1 5/2002 Chevalier et al.
6,460,555 B1 10/2002 Tuller et al.
6,491,049 B1 12/2002 Tuller et al.
6,601,593 B2 8/2003 Deiss et al.
6,666,976 B2 12/2003 Benenson, Jr. et al.
6,675,437 B1 1/2004 York
6,800,197 B1 10/2004 Kosola et al.
6,997,195 B2 2/2006 Durazzani et al.
7,047,986 B2 5/2006 Ertle et al.
7,069,181 B2 6/2006 Jerg et al.
7,093,604 B2 8/2006 Jung et al.
7,153,817 B2 12/2006 Binder
7,198,054 B2 4/2007 Welch
7,208,080 B2 4/2007 Batten et al.
7,232,494 B2 6/2007 Rappette
7,250,174 B2 7/2007 Lee et al.
7,270,132 B2 9/2007 Inui et al.
7,319,841 B2 1/2008 Bateman, III et al.
7,326,338 B2 2/2008 Batten et al.
7,347,212 B2 3/2008 Rosenbauer
7,350,527 B2 4/2008 Gurubatham et al.
7,363,093 B2 4/2008 King et al.
7,406,843 B2 8/2008 Thies et al.
7,445,013 B2 11/2008 VanderRoest et al.
7,497,222 B2 3/2009 Edwards et al.
7,523,758 B2 4/2009 VanderRoest et al.
7,594,513 B2 9/2009 VanderRoest et al.
7,819,983 B2 10/2010 Kim et al.
8,038,802 B1 10/2011 Tuller
8,043,437 B1 10/2011 Delgado et al.
8,161,986 B2 4/2012 Alessandrelli
8,215,322 B2 7/2012 Fountain et al.
8,627,832 B2 1/2014 Fountain et al.
8,667,974 B2 3/2014 Fountain et al.
8,746,261 B2 6/2014 Welch
9,034,112 B2 5/2015 Tuller et al.
9,538,898 B2 1/2017 Tuller et al.
2002/0017483 A1 2/2002 Chesner et al.
2003/0037809 A1 2/2003 Favaro
2003/0205248 A1 11/2003 Christman et al.
2004/0007253 A1 1/2004 Jung et al.
2004/0103926 A1 6/2004 Ha
2005/0022849 A1 2/2005 Park et al.
2005/0133070 A1 6/2005 Vanderroest et al.
2006/0005863 A1 1/2006 Gurubatham et al.
2006/0054549 A1 3/2006 Schoendorfer
2006/0123563 A1 6/2006 Raney et al.
2006/0162744 A1 7/2006 Walkden
2006/0174915 A1 8/2006 Hedstrom et al.
2006/0236556 A1 10/2006 Ferguson et al.
2006/0237049 A1 10/2006 Weaver et al.
2007/0006898 A1 1/2007 Lee
2007/0107753 A1 5/2007 Jerg
2007/0163626 A1 7/2007 Klein
2007/0186964 A1 8/2007 Mason et al.
2007/0246078 A1 10/2007 Purtilo et al.
2007/0266587 A1 11/2007 Bringewatt et al.
2008/0116135 A1 5/2008 Rieger et al.
2008/0289654 A1 11/2008 Kim et al.
2008/0289664 A1 11/2008 Rockwell et al.
2009/0095330 A1 4/2009 Iwanaga et al.
2009/0283111 A1 11/2009 Classen et al.
2010/0012159 A1 1/2010 Verma et al.
2010/0043826 A1 2/2010 Bertsch et al.
2010/0043847 A1 2/2010 Yoon et al.
2010/0121497 A1 5/2010 Heisele et al.
2010/0154830 A1 6/2010 Lau et al.
2010/0154841 A1 6/2010 Fountain et al.
2010/0224223 A1 9/2010 Kehl et al.
2010/0252081 A1 10/2010 Classen et al.
2010/0300499 A1 12/2010 Han et al.
2011/0061682 A1* 3/2011 Fountain ..... A47L 15/4206 134/10
2011/0120508 A1 5/2011 Yoon et al.
2011/0126865 A1 6/2011 Yoon et al.
2011/0146714 A1 6/2011 Fountain et al.
2011/0146730 A1 6/2011 Welch
2011/0146731 A1 6/2011 Fountain et al.
2011/0197933 A1 8/2011 Yoon et al.
2011/0214702 A1 9/2011 Brown-West et al.
2012/0097200 A1 4/2012 Fountain
2012/0118330 A1 5/2012 Tuller et al.
2012/0118336 A1 5/2012 Welch
2012/0138096 A1 6/2012 Tuller et al.
2012/0138106 A1 6/2012 Fountain et al.
2012/0138107 A1 6/2012 Fountain et al.
2012/0167928 A1 7/2012 Fountain et al.
2012/0291805 A1 11/2012 Tuller et al.
2012/0291822 A1 11/2012 Tuller et al.
2012/0318295 A1 12/2012 Delgado et al.
2012/0318296 A1 12/2012 Fountain et al.

FOREIGN PATENT DOCUMENTS

CN 2761660 3/2006
CN 1966129 5/2007
CN 2907830 6/2007
CN 101406379 4/2009
CN 201276653 7/2009
CN 201361486 12/2009
CN 101654855 2/2010
CN 201410325 2/2010
CN 201473770 5/2010
DE 1134489 8/1961
DE 1428358 A1 11/1968
DE 1453070 3/1969
DE 7105474 8/1971
DE 7237309 U 9/1973
DE 2825242 A1 1/1979
DE 3337369 A1 4/1985
DE 3723721 A1 5/1988
DE 3842997 A1 7/1990
DE 4011834 A1 10/1991
DE 4016915 A1 11/1991
DE 4131914 A1 4/1993
DE 9415486 U1 11/1994
DE 9416710 U1 1/1995

(56) References Cited

FOREIGN PATENT DOCUMENTS

| | | | | |
|---|---|---|---|---|
| DE | 4413432 | C1 | 8/1995 | |
| DE | 4418523 | A1 | 11/1995 | |
| DE | 4433842 | | 3/1996 | |
| DE | 69111365 | T2 | 3/1996 | |
| DE | 19546965 | A1 | 6/1997 | |
| DE | 69403957 | T2 | 1/1998 | |
| DE | 19652235 | | 6/1998 | |
| DE | 10000772 | A1 | 7/2000 | |
| DE | 69605965 | T2 | 8/2000 | |
| DE | 19951838 | A1 | 5/2001 | |
| DE | 10065571 | A1 | 7/2002 | |
| DE | 10106514 | A1 | 8/2002 | |
| DE | 60206490 | T2 | 5/2006 | |
| DE | 60302143 | | 8/2006 | |
| DE | 102005023428 | A1 | 11/2006 | |
| DE | 102005038433 | A1 | 2/2007 | |
| DE | 102007007133 | A1 | 8/2008 | |
| DE | 102007060195 | A1 | 6/2009 | |
| DE | 202010006739 | U1 | 8/2010 | |
| DE | 102009027910 | A1 | 1/2011 | |
| DE | 102009028278 | A1 | 2/2011 | |
| DE | 102010061215 | A1 | 6/2011 | |
| DE | 102011052846 | A1 | 5/2012 | |
| DE | 102010061346 | A1 | 6/2012 | |
| DE | 102012103435 | A1 | 12/2012 | |
| EP | 0068974 | A1 | 1/1983 | |
| EP | 0178202 | A1 | 4/1986 | |
| EP | 0198496 | A1 | 10/1986 | |
| EP | 0208900 | A2 | 1/1987 | |
| EP | 0370552 | A1 | 5/1990 | |
| EP | 0374616 | A1 | 6/1990 | |
| EP | 0383028 | A2 | 8/1990 | |
| EP | 0405627 | A1 | 1/1991 | |
| EP | 137189 | A1 | 7/1991 | |
| EP | 0454640 | A1 | 10/1991 | |
| EP | 0521815 | A1 | 1/1993 | |
| EP | 0585905 | A2 | 9/1993 | |
| EP | 0702928 | A1 | 8/1995 | |
| EP | 0597907 | B1 | 12/1995 | |
| EP | 0725182 | A1 | 8/1996 | |
| EP | 0748607 | A2 | 12/1996 | |
| EP | 152231 | A1 | 1/1997 | |
| EP | 0752231 | A1 * | 1/1997 | ..... A47L 15/4206 |
| EP | 0752231 | A1 | 1/1997 | |
| EP | 0854311 | A2 | 7/1998 | |
| EP | 0855165 | A2 | 7/1998 | |
| EP | 0898928 | A1 | 3/1999 | |
| EP | 1029965 | A1 | 8/2000 | |
| EP | 1224902 | A2 | 7/2002 | |
| EP | 1256308 | A2 | 11/2002 | |
| EP | 1264570 | | 12/2002 | |
| EP | 1319360 | A1 | 6/2003 | |
| EP | 1342827 | | 9/2003 | |
| EP | 1346680 | A2 | 9/2003 | |
| EP | 1386575 | A1 | 2/2004 | |
| EP | 1415587 | | 5/2004 | |
| EP | 1498065 | A1 | 1/2005 | |
| EP | 1583455 | A1 | 10/2005 | |
| EP | 1703834 | A1 | 9/2006 | |
| EP | 1743871 | A1 | 1/2007 | |
| EP | 1862104 | A1 | 12/2007 | |
| EP | 1882436 | A1 | 1/2008 | |
| EP | 1980193 | A1 | 10/2008 | |
| EP | 2127587 | A1 | 2/2009 | |
| EP | 2075366 | A1 | 7/2009 | |
| EP | 2138087 | A1 | 12/2009 | |
| EP | 2332457 | A1 | 6/2011 | |
| EP | 2335547 | A1 | 6/2011 | |
| EP | 2338400 | A1 | 6/2011 | |
| EP | 2351507 | A1 | 8/2011 | |
| FR | 1370521 | A | 8/1964 | |
| FR | 2372363 | A1 | 6/1978 | |
| FR | 2491320 | A1 | 4/1982 | |
| FR | 2491321 | A1 | 4/1982 | |
| FR | 2790013 | A1 | 8/2000 | |
| GB | 973859 | A | 10/1964 | |
| GB | 1047948 | | 11/1966 | |
| GB | 1123789 | A | 8/1968 | |
| GB | 1515095 | | 6/1978 | |
| GB | 2274772 | A | 8/1994 | |
| JP | 55039215 | A | 3/1980 | |
| JP | 60069375 | A | 4/1985 | |
| JP | 61085991 | A | 5/1986 | |
| JP | 61200824 | A | 9/1986 | |
| JP | 1005521 | A | 1/1989 | |
| JP | 1080331 | A | 3/1989 | |
| JP | 6245094 | A | 9/1993 | |
| JP | 07178030 | | 7/1995 | |
| JP | 10109007 | A | 4/1998 | |
| JP | 2000107114 | A | 4/2000 | |
| JP | 2001190479 | A | 7/2001 | |
| JP | 2001190480 | A | 7/2001 | |
| JP | 2003336909 | A | 12/2003 | |
| JP | 2003339607 | A | 12/2003 | |
| JP | 2004267507 | A | 9/2004 | |
| JP | 2005124979 | A | 5/2005 | |
| JP | 2006075635 | A | 3/2006 | |
| JP | 2007068601 | A | 3/2007 | |
| JP | 2008093196 | A | 4/2008 | |
| JP | 2008253543 | A | 10/2008 | |
| JP | 2008264018 | A | 11/2008 | |
| JP | 2008264724 | A | 11/2008 | |
| JP | 2010035745 | A | 2/2010 | |
| JP | 2010187796 | A | 9/2010 | |
| KR | 20010077128 | | 8/2001 | |
| WO | 2005058124 | A1 | 6/2005 | |
| WO | 2005060813 | A1 | 7/2005 | |
| WO | 2005115216 | A1 | 12/2005 | |
| WO | 2007024491 | A2 | 3/2007 | |
| WO | 2007074024 | A1 | 7/2007 | |
| WO | 2008067898 | A1 | 6/2008 | |
| WO | 2008125482 | A2 | 10/2008 | |
| WO | 2009018903 | A1 | 2/2009 | |
| WO | 2009065696 | A1 | 5/2009 | |
| WO | 2009077266 | A1 | 6/2009 | |
| WO | 2009077279 | A2 | 6/2009 | |
| WO | 2009077280 | A1 | 6/2009 | |
| WO | 2009077283 | A1 | 6/2009 | |
| WO | 2009077286 | A1 | 6/2009 | |
| WO | 2009077290 | A1 | 6/2009 | |
| WO | 2009118308 | A1 | 10/2009 | |
| WO | 2010073185 | A1 | 7/2010 | |

OTHER PUBLICATIONS

German Search Report for Counterpart DE102013109125, dated Dec. 9, 2013.
European Search Report for EP101952380, dated May 19, 2011.
European Search Report for EP11188106, dated Mar. 29, 2012.
European Search Report for EP12188007, dated Aug. 6, 2013.
German Search Report for DE102010061347, dated Jan. 23, 2013.
German Search Report for DE102010061215, dated Feb. 7, 2013.
German Search Report for DE102010061346, dated Sep. 30, 2011.
German Search Report for DE102010061343, dated Jul. 7, 2011.
German Search Report for DE102011053666, dated Oct. 21, 2011.
German Search Report for DE102013103264, dated Jul. 12, 2013.
Ishihara et al., JP 11155792 A, English Machine Translation, 1999, pp. 1-14.
German Search Report for Counterpart DE102014101260.7, dated Sep. 18, 2014.
European Search Report for EP121914675, dated Dec. 5, 2012.

* cited by examiner

ROTATING FILTER FOR A DISHWASHING MACHINE

CROSS-REFERENCE TO RELATED APPLICATION(S)

This application is a Divisional Application of and claims priority to U.S. patent application Ser. No. 13/164,066, filed on Jun. 20, 2011, entitled "ROTATING FILTER FOR A DISHWASHING MACHINE," now U.S. Pat. No. 9,265,401, the disclosure of which is hereby incorporated herein by reference in its entirety.

BACKGROUND OF THE INVENTION

A dishwashing machine is a domestic appliance into which dishes and other cooking and eating wares (e.g., plates, bowls, glasses, flatware, pots, pans, bowls, etc.) are placed to be washed. A dishwashing machine includes various filters to separate soil particles from wash fluid.

SUMMARY OF THE INVENTION

The invention relates to a dishwasher with a liquid spraying system, a liquid recirculation system, and a liquid filtering system. The liquid filtering system includes a housing defining a chamber, a rotating filter having an upstream surface and a downstream surface and located within the chamber such that the recirculation flow path passes through the filter from the upstream surface to the downstream surface to effect a filtering of the sprayed liquid, and a first artificial boundary extending from the housing and into the chamber to overly at least a portion of the upstream surface to form an increased shear force zone between the first artificial boundary and the upstream surface, wherein liquid passing between the first artificial boundary and the rotating filter applies a greater shear force on the upstream surface than liquid in an absence of the first artificial boundary.

DESCRIPTION OF EMBODIMENTS OF THE INVENTION

Figure 1:
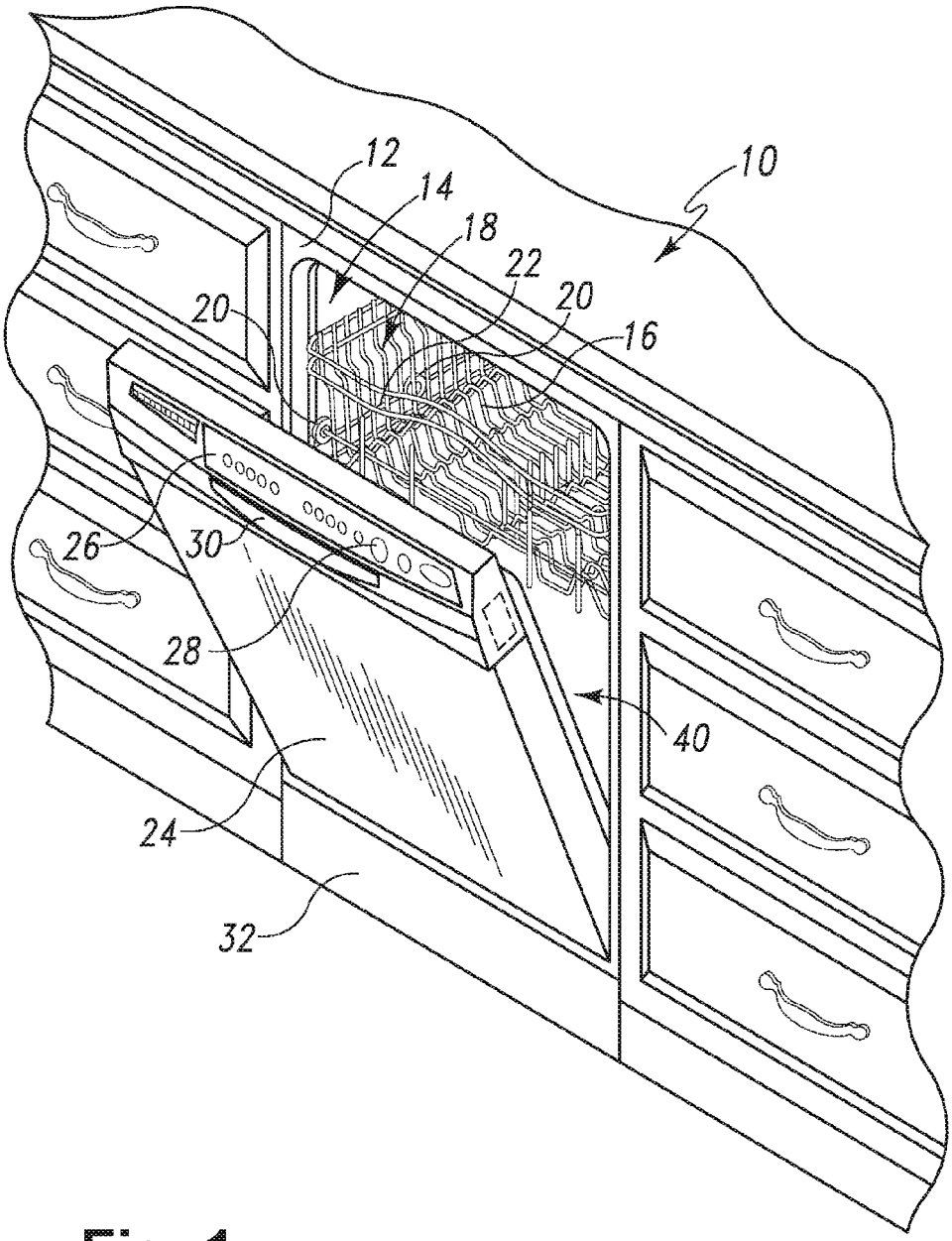
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a dishwashing machine 10 (hereinafter dishwasher 10) is shown. The dishwasher 10 has a tub 12 that at least partially defines a washing chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish racks 16 and the tub 12. The roller assemblies 18 allow the dish racks 16 to extend from and retract into the tub 12, which facilitates the loading and unloading of the dish racks 16. The roller assemblies 18 include a number of rollers 20 that move along a corresponding support rail 22.

A door 24 is hinged to the lower front edge of the tub 12. The door 24 permits user access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, which are used by a controller (not shown) to control the operation of the dishwasher 10. A handle 30 is also included in the control panel 26. The user may use the handle 30 to unlatch and open the door 24 to access the tub 12.

Figure 2:
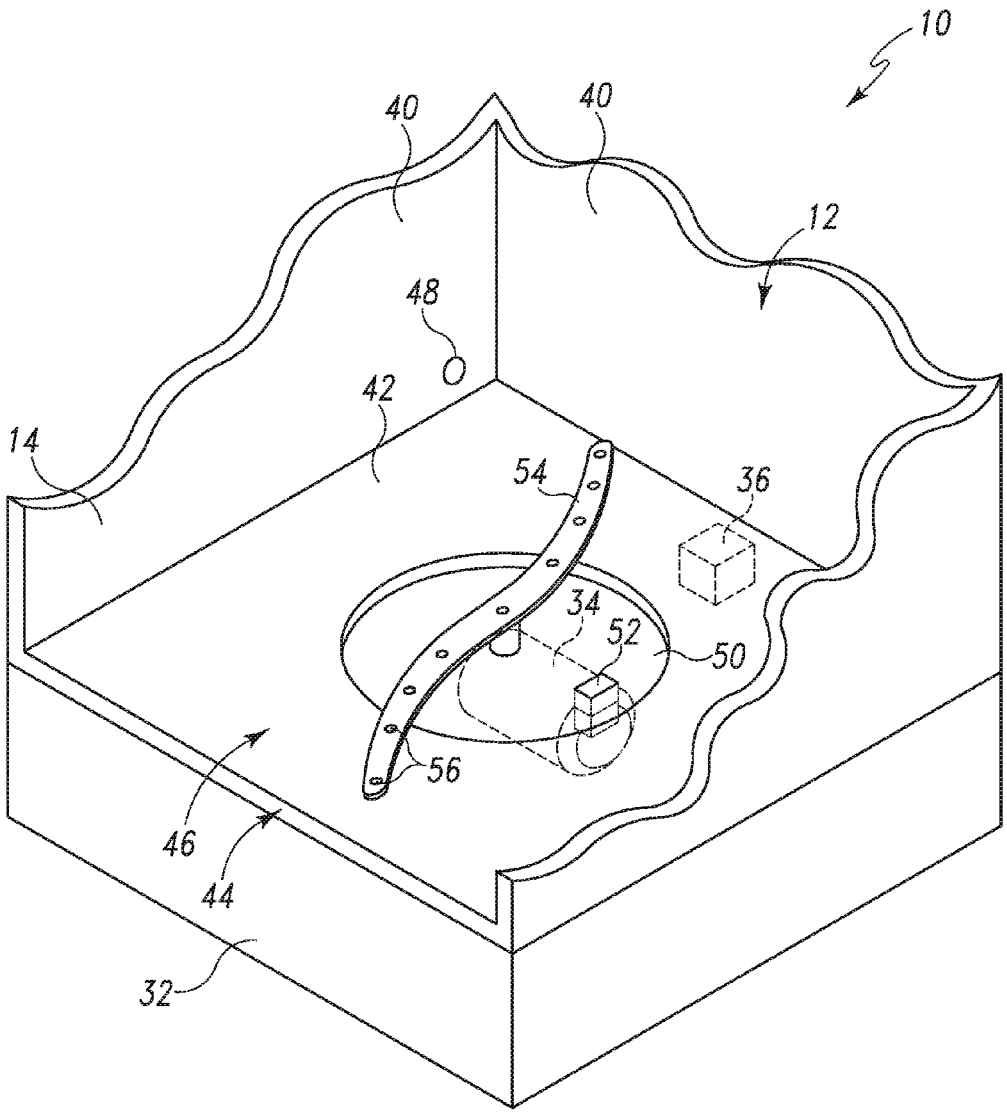
FIG. 2 is a fragmentary perspective view of the tub of the dishwashing machine of FIG. 1.

A machine compartment 32 is located below the tub 12. The machine compartment 32 is sealed from the tub 12. In other words, unlike the tub 12, which is filled with fluid and exposed to spray during the wash cycle, the machine compartment 32 does not fill with fluid and is not exposed to spray during the operation of the dishwasher 10. Referring now to FIG. 2, the machine compartment 32 houses a recirculation pump assembly 34 and the drain pump 36, as well as the dishwasher's other motor(s) and valve(s), along with the associated wiring and plumbing. The recirculation pump 34 and associated wiring and plumbing form a liquid recirculation system.

The tub 12 of the dishwasher 10 is shown in greater detail. The tub 12 includes a number of side walls 40 extending upwardly from a bottom wall 42 to define the washing chamber 14. The open front side 44 of the tub 12 defines an access opening 46 of the dishwasher 10. The access opening 46 provides the user with access to the dish racks 16 positioned in the washing chamber 14 when the door 24 is open. When closed, the door 24 seals the access opening 46, which prevents the user from accessing the dish racks 16. The door 24 also prevents fluid from escaping through the access opening 46 of the dishwasher 10 during a wash cycle.

The bottom wall 42 of the tub 12 has a sump 50 positioned therein. At the start of a wash cycle, fluid enters the tub 12 through a hole 48 defined in the side wall 40. The sloped configuration of the bottom wall 42 directs fluid into the sump 50. The recirculation pump assembly 34 removes such water and/or wash chemistry from the sump 50 through a hole 52 defined in the bottom of the sump 50 after the sump 50 is partially filled with fluid.

The liquid recirculation system supplies liquid to a liquid spraying system, which includes a spray arm 54, to recirculate the sprayed liquid in the tub 12. The recirculation pump assembly 34 is fluidly coupled to a rotating spray arm 54 that sprays water and/or wash chemistry onto the dish racks 16 (and hence any wares positioned thereon) to effect a recirculation of the liquid from the washing chamber 14 to the liquid spraying system to define a recirculation flow path. Additional rotating spray arms (not shown) are positioned above the spray arm 54. It should also be appreciated that the dishwashing machine 10 may include other spray arms positioned at various locations in the tub 12. As shown in FIG. 2, the spray arm 54 has a number of nozzles 56. Fluid passes from the recirculation pump assembly 34 into the spray arm 54 and then exits the spray arm 54 through the nozzles 56. In the illustrative embodiment described herein, the nozzles 56 are embodied simply as holes formed in the spray arm 54. However, it is within the scope of the disclosure for the nozzles 56 to include inserts such as tips or other similar structures that are placed into the holes formed in the spray arm 54. Such inserts may be useful in configuring the spray direction or spray pattern of the fluid expelled from the spray arm 54.

After wash fluid contacts the dish racks 16, and any wares positioned in the washing chamber 14, a mixture of fluid and soil falls onto the bottom wall 42 and collects in the sump 50. The recirculation pump assembly 34 draws the mixture out of the sump 50 through the hole 52. As will be discussed in detail below, fluid is filtered in the recirculation pump assembly 34 and re-circulated onto the dish racks 16. At the conclusion of the wash cycle, the drain pump 36 removes both wash fluid and soil particles from the sump 50 and the tub 12.

Figure 3:
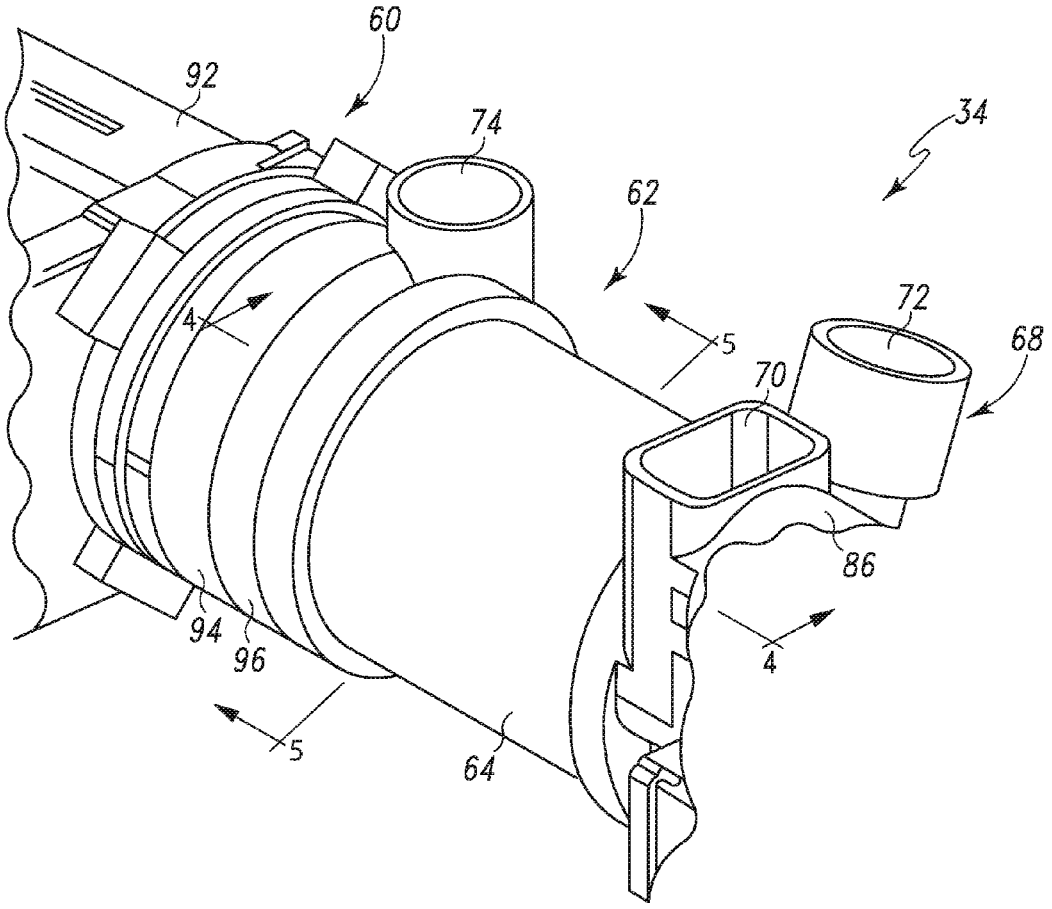
FIG. 3 is a perspective view of an embodiment of a pump and filter assembly for the dishwashing machine of FIG. 1.

Referring now to FIG. 3, the recirculation pump assembly 34 is shown removed from the dishwasher 10. The recirculation pump assembly 34 includes a wash pump 60 that is secured to a housing 62. The housing 62 includes cylindrical filter casing 64 positioned between a manifold 68 and the wash pump 60. The cylindrical filter casing 64 provides a liquid filtering system. The manifold 68 has an inlet port 70, which is fluidly coupled to the hole 52 defined in the sump 50, and an outlet port 72, which is fluidly coupled to the drain pump 36. Another outlet port 74 extends upwardly from the wash pump 60 and is fluidly coupled to the rotating spray arm 54. While recirculation pump assembly 34 is included in the dishwasher 10, it will be appreciated that in other embodiments, the recirculation pump assembly 34 may be a device separate from the dishwasher 10. For example, the recirculation pump assembly 34 might be positioned in a cabinet adjacent to the dishwasher 10. In such embodiments, a number of fluid hoses may be used to connect the recirculation pump assembly 34 to the dishwasher 10.

Figure 4:
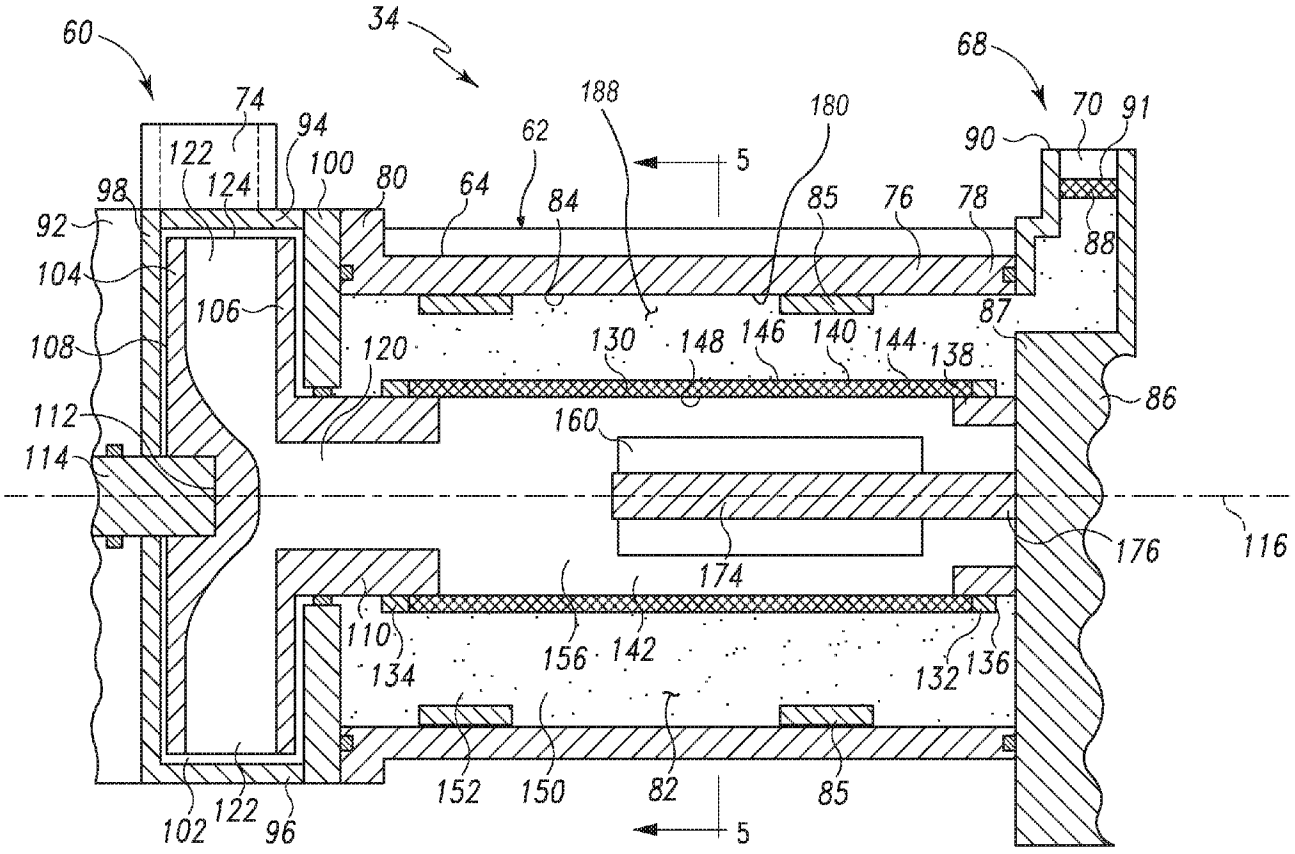
FIG. 4 is a cross-sectional view of the pump and filter assembly of FIG. 3 taken along the line 4-4 shown in FIG. 3.

Referring now to FIG. 4, a cross-sectional view of the recirculation pump assembly 34 is shown. The filter casing 64 is a hollow cylinder having a side wall 76 that extends from an end 78 secured to the manifold 68 to an opposite end 80 secured to the wash pump 60. The side wall 76 defines a filter chamber 82 through which the recirculation flow path passes and that extends the length of the filter casing 64.

The side wall 76 has an inner surface 84 facing the filter chamber 82. A number of rectangular ribs 85 extend from the inner surface 84 into the filter chamber 82. The ribs 85 are configured to create drag to counteract the movement of fluid within the filter chamber 82. It should be appreciated that in other embodiments, each of the ribs 85 may take the form of a wedge, cylinder, pyramid, or other shape configured to create drag to counteract the movement of fluid within the filter chamber 82.

The manifold 68 has a main body 86 that is secured to the end 78 of the filter casing 64. The inlet port 70 extends upwardly from the main body 86 and is configured to be coupled to a fluid hose (not shown) extending from the hole 52 defined in the sump 50. The inlet port 70 opens through a sidewall 87 of the main body 86 into the filter chamber 82 of the filter casing 64. As such, during the wash cycle, a mixture of fluid and soil particles advances from the sump 50 into the filter chamber 82 and fills the filter chamber 82. As shown in FIG. 4, the inlet port 70 has a filter screen 88 positioned at an upper end 90. The filter screen 88 has a plurality of holes 91 extending there through. Each of the holes 91 is sized such that large soil particles are prevented from advancing into the filter chamber 82.

A passageway (not shown) places the outlet port 72 of the manifold 68 in fluid communication with the filter chamber 82. When the drain pump 36 is energized, fluid and soil particles from the sump 50 pass downwardly through the inlet port 70 into the filter chamber 82. Fluid then advances from the filter chamber 82 through the passageway and out the outlet port 72.

The wash pump 60 is secured at the opposite end 80 of the filter casing 64. The wash pump 60 includes a motor 92 (see FIG. 3) secured to a cylindrical pump housing 94. The pump housing 94 includes a side wall 96 extending from a base wall 98 to an end wall 100. The base wall 98 is secured to the motor 92 while the end wall 100 is secured to the end 80 of the filter casing 64. The walls 96, 98, 100 define an impeller chamber 102 that fills with fluid during the wash cycle. As shown in FIG. 4, the outlet port 74 is coupled to the side wall 96 of the pump housing 94 and opens into the chamber 102. The outlet port 74 is configured to receive a fluid hose (not shown) such that the outlet port 74 may be fluidly coupled to the spray arm 54.

The wash pump 60 also includes an impeller 104. The impeller 104 has a shell 106 that extends from a back end 108 to a front end 110. The back end 108 of the shell 106 is positioned in the chamber 102 and has a bore 112 formed therein. A drive shaft 114, which is rotatably coupled to the motor 92, is received in the bore 112. The motor 92 acts on the drive shaft 114 to rotate the impeller 104 about an imaginary axis 116 in the direction indicated by arrow 118 (see FIG. 5). The motor 92 is connected to a power supply (not shown), which provides the electric current necessary for the motor 92 to spin the drive shaft 114 and rotate the impeller 104. In the illustrative embodiment, the motor 92 is configured to rotate the impeller 104 about the axis 116 at 3200 rpm.

The front end 110 of the impeller shell 106 is positioned in the filter chamber 82 of the filter casing 64 and has an inlet opening 120 formed in the center thereof. The shell 106 has a number of vanes 122 that extend away from the inlet opening 120 to an outer edge 124 of the shell 106. The rotation of the impeller 104 about the axis 116 draws fluid from the filter chamber 82 of the filter casing 64 into the inlet opening 120. The fluid is then forced by the rotation of the impeller 104 outward along the vanes 122. Fluid exiting the impeller 104 is advanced out of the chamber 102 through the outlet port 74 to the spray arm 54.

As shown in FIG. 4, the front end 110 of the impeller shell 106 is coupled to a rotary filter 130 positioned in the filter chamber 82 of the filter casing 64. The filter 130 has a cylindrical filter drum 132 extending from an end 134 secured to the impeller shell 106 to an end 136 rotatably coupled to a bearing 138, which is secured the main body 86 of the manifold 68. As such, the filter 130 is operable to rotate about the axis 116 with the impeller 104.

A filter sheet 140 extends from one end 134 to the other end 136 of the filter drum 132 and encloses a hollow interior 142. The rotating filter 130 may be thought of as being located within the recirculation flow path and has an upstream surface 146 and a downstream surface 148 such that the recirculating liquid passes through the rotating filter 130 from the upstream surface 146 to the downstream surface 148 to effect a filtering of the liquid. In the described flow direction, the upstream surface 146 correlates to the outer surface and the downstream surface 148 correlates to the inner surface. The sheet 140 includes a number of holes 144, and each hole 144 extends from an upstream surface 146 of the sheet 140 to a downstream surface 148. In the illustrative embodiment, the sheet 140 is a sheet of chemically etched metal. Each hole 144 is sized to allow for the passage of wash fluid into the hollow interior 142 and prevent the passage of soil particles.

As such, the filter sheet 140 divides the filter chamber 82 into two parts. As wash fluid and removed soil particles enter the filter chamber 82 through the inlet port 70, a mixture 150 of fluid and soil particles is collected in the filter chamber 82 in a region 152 external to the filter sheet 140. Because the holes 144 permit fluid to pass into the hollow interior 142, a volume of filtered fluid 156 is formed in the hollow interior 142.

Figure 5:
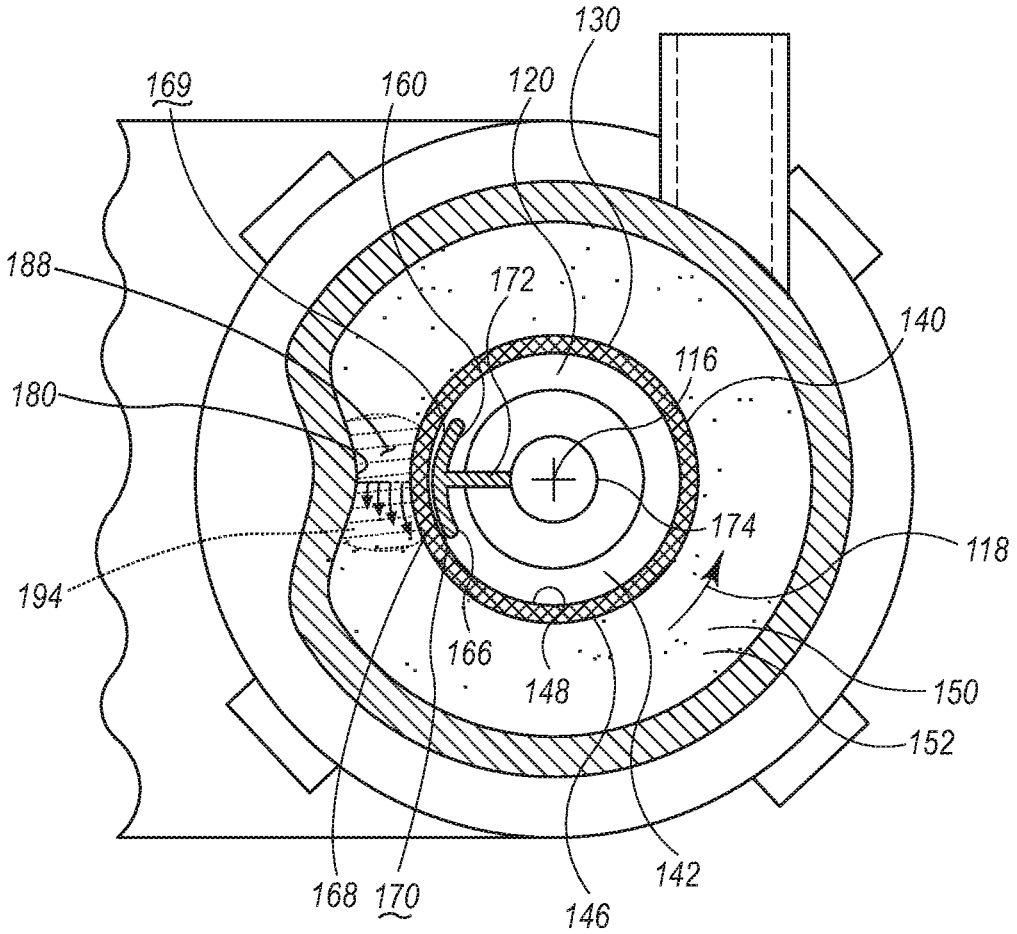
FIG. 5 is a cross-sectional elevation view of the pump and filter assembly of FIG. 3 taken along the line 5-5 shown in FIG. 3.

Referring to FIG. 5, an optional inner flow diverter or artificial boundary 160 may be positioned in the hollow interior 142 of the filter 130. The artificial boundary 160 has a body 166 that is positioned adjacent to the downstream surface 148 of the sheet 140. The body 166 has an outer surface 168 that is shaped in such a manner that a leading gap 169 is formed when the body 166 is positioned adjacent to the downstream surface 148 of the sheet 140. A trailing gap 170, which is smaller than the leading gap 169, is also formed when the body 166 is positioned adjacent to the downstream surface 148 of the sheet 140. An arm 172 may extend away from the body 166 and may secure the artificial boundary 160 to a beam 174 positioned in the center of the filter 130. The beam 174 is coupled at an end 176 to the side wall 87 of the manifold 68. In this way, the beam 174 secures the body 166 to the housing 62.

An external flow diverter or artificial boundary 180 may extend from the housing 62 toward and overlaying a portion of the upstream surface 146. The artificial boundary 180 may extend along the length of the filter 130 from one end 134 to the other end 136. The artificial boundary 180 may be continuous. Alternatively, it may be discontinuous.

The artificial boundary 180 is illustrated as being a change in the cross-sectional shape of a constant-thickness housing, which extends toward and overlies the filter. In such a case, the artificial boundary 180 is integral with the housing 62 although this need not be the case. As will be seen in subsequent embodiments, it is possible to accomplish the same result by creating a projection from the housing, which essentially alters the thickness of the housing such that a portion extends towards and overlies the filter. The projection may be formed with or attached to the housing to be integrated within the housing. Another alternative is to asymmetrically locate the filter within the housing such that a portion of the housing overlies the filter.

The artificial boundary 180 may be positioned in a partially or completely radial overlapping relationship with the artificial boundary 160 and spaced apart from the artificial boundary 180 so as to create a gap 188 therebetween. The sheet 140 is positioned within the gap 188. In some cases, the shear zone benefit may be created with the artificial boundaries being in proximity to each other and not radially overlapping to any extent.

In operation, wash fluid, such as water and/or wash chemistry (i.e., water and/or detergents, enzymes, surfactants, and other cleaning or conditioning chemistry), enters the tub 12 through the hole 48 defined in the side wall 40 and flows into the sump 50 and down the hole 52 defined therein. As the filter chamber 82 fills, wash fluid passes through the holes 144 extending through the filter sheet 140 into the hollow interior 142. After the filter chamber 82 is completely filled and the sump 50 is partially filled with wash fluid, the dishwasher 10 activates the motor 92.

Activation of the motor 92 causes the impeller 104 and the filter 130 to rotate. The rotation of the impeller 104 creates a suction force that draws wash fluid from the filter chamber 82 through the filter sheet 140 and into the inlet opening 120 of the impeller shell 106. Fluid then advances outward along the vanes 122 of the impeller shell 106 and out of the chamber 102 through the outlet port 74 to the spray arm 54. When wash fluid is delivered to the spray arm 54, it is expelled from the spray arm 54 onto any dishes or other wares positioned in the washing chamber 14. Wash fluid removes soil particles located on the dishwares, and the mixture of wash fluid and soil particles falls onto the bottom wall 42 of the tub 12. The sloped configuration of the bottom wall 42 directs that mixture into the sump 50 and down the hole 52 defined in the sump 50.

While fluid is permitted to pass through the sheet 140, the size of the holes 144 prevents the soil particles of the mixture 152 from moving into the hollow interior 142. As a result, those soil particles accumulate on the upstream surface 146 of the sheet 140 and cover the holes 144, thereby preventing fluid from passing into the hollow interior 142.

The rotation of the filter 130 about the axis 116 causes the unfiltered liquid or mixture 150 of fluid and soil particles within the filter chamber 82 to rotate about the axis 116 in the direction indicated by the arrow 118. Centrifugal force urges the soil particles toward the side wall 76 as the mixture 150 rotates about the axis 116. As the liquid advances through the gap 188, the angular velocity of the liquid increases relative to its previous velocity and an increased shear zone 194 is formed by the significant increase in angular velocity of the liquid in the relatively short distance between the first artificial boundary 180 and the rotating filter 130.

As the first artificial boundary 180 is stationary, the liquid in contact with the first artificial boundary 180 is also stationary or has no rotational speed. The liquid in contact with the upstream surface 146 has the same angular speed as the rotating filter 130, which is generally in the range of 3000 rpm, which may vary between 1000 to 5000 rpm. The speed of rotation is not limiting to the invention. The increase in the angular speed of the liquid is illustrated as increasing length arrows, the longer the arrow length the faster the speed of the liquid. Thus, the liquid in the increased shear zone 194 has an angular speed profile of zero where it is constrained at the first artificial boundary 180 to approximately 3000 rpm at the upstream surface 146, which requires substantial angular acceleration, which locally generates the increased shear forces on the upstream surface 146. Thus, the proximity of the first artificial boundary 180 to the rotating filter 130 causes an increase in the angular velocity of the liquid portion 190 and results in a shear force being applied on the upstream surface 146.

This applied shear force aids in the removal of soils on the upstream surface 146 and is attributable to the interaction of the liquid and the rotating filter 130. The increased shear zone 194 functions to remove and/or prevent soils from being trapped on the upstream surface 146. The liquid passing between the first artificial boundary 180 and the rotating filter 130 applies a greater shear force on the upstream surface 146 than liquid in an absence of the first artificial boundary 180.

The orientation of the body 166 such that it has a larger leading gap 169 that reduces to a smaller trailing gap 170 results in a decreasing cross-sectional area between the outer surface 168 of the body 166 and the downstream surface 148 of the filter sheet 140 along the direction of fluid flow between the body 166 and the filter sheet 140, which creates a wedge action that forces water from the hollow interior 142 through a number of holes 144 to the upstream surface 146 of the sheet 140. Thus, a backflow is induced by the leading gap 169. The backflow of water against accumulated soil particles on the sheet 140 better cleans the sheet 140. Further, an increase in shear force may occur on the downstream surface 148 where the artificial boundary 160 overlies the downstream surface 148. The liquid would have an angular speed profile of zero at the artificial boundary 160 and would increase to approximately 3000 rpm at the downstream surface 148, which generates the increased shear forces.

Figure 6:
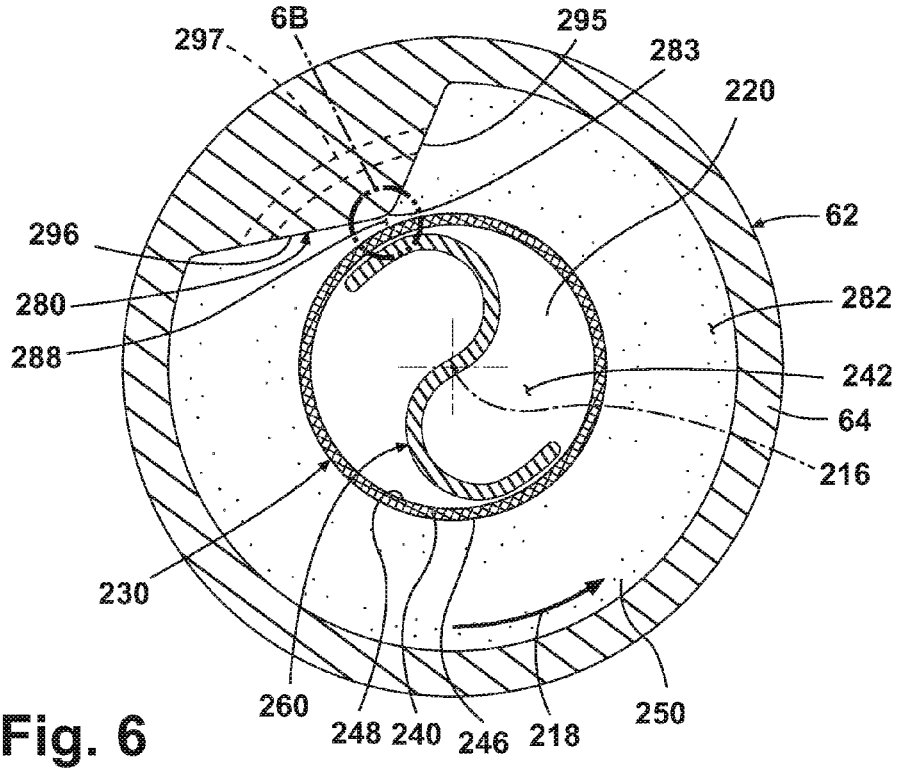
FIGS. 6, 6A, and 6B are cross-sectional elevation views of a pump and filter assembly according to a second embodiment.
Figure 6A:
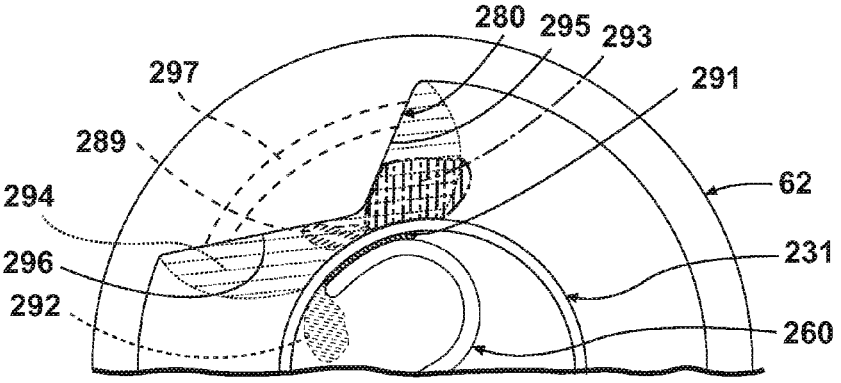
Figure 6B:
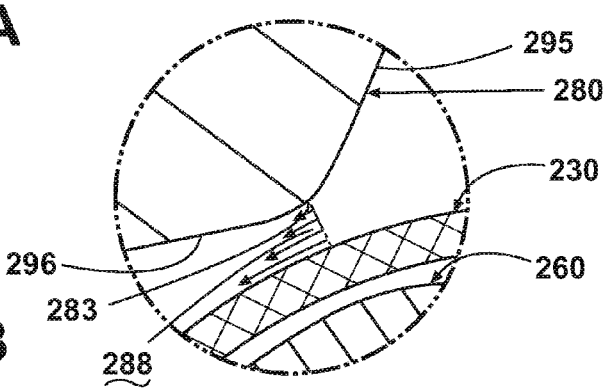

FIGS. 6-6B illustrate a second embodiment of the rotating filter 230, with the structure being shown in FIG. 6, the resulting increased shear zone 294 and pressure zones being shown in FIG. 6A, and the angular speed profile of liquid in the increased shear zone 294 is shown in FIG. 6B. The second embodiment is similar to the first embodiment; therefore, like parts will be identified with like numerals increased by 100, with it being understood that the description of the like parts of the first embodiment applies to the second embodiment, unless otherwise noted.

One difference between the second embodiment and the first embodiment is that the second embodiment includes an artificial boundary 280 that terminates in a tip 283 near the upstream surface 246. The artificial boundary 280 includes a first surface 295 facing upstream to the recirculation flow path and a second surface 296 facing downstream to the recirculation flow path. The artificial boundary 280 has an asymmetrical cross section and the first surface 295 forms a smaller angle relative to the recirculation flow path than the second surface 296.

Another difference is that the second embodiment illustrates that the artificial boundary 280 may include at least one slot 297 such that liquid may pass through both the slot 297 and the gap 288. The slot 297 may extend along the length of the filter 230 or some portion thereof. Further, multiple slots 297 may be included. In the case where the artificial boundary 280 is not integral with the housing 62, it is contemplated that at least a portion of the slot 297 may be located between the tip 283 and the housing 62 or that the slot 297 may be located adjacent the housing 62. When the artificial boundary 280 is integral with the housing 62, as illustrated, the slot 297 may run through the housing 62.

Another difference is that the artificial boundary 260 is illustrated as having two concave deflector portions that are spaced about the downstream surface 248. The two concave deflector portions may be joined to form a single second artificial boundary 260, as illustrated, having an S-shape cross section. Alternatively, it has been contemplated that the two concave deflector portions may form two separate second artificial boundaries. The second artificial boundary 260 may extend axially within the rotating filter 230 to form a flow straightener. Such a flow straightener reduces the rotation of the liquid before the impeller 104 and improves the efficiency of the impeller 104.

The second embodiment operates much the same way as the first embodiment. That is, during operation of the dishwasher 10, liquid is recirculated and sprayed by a spray arm 54 of the spraying system to supply a spray of liquid to the washing chamber 14. The liquid then falls onto the bottom wall 42 of the tub 12 and flows to the filter chamber 82. The housing or casing 64, which defines the filter chamber 82, may be physically remote from the tub 12 such that the filter chamber 82 may form a sump that is also remote from the tub 12. Activation of the motor 92 causes the impeller 104 and the filter 230 to rotate. The rotation of the impeller 104 draws wash fluid from an upstream side in the filter chamber 82 through the rotating filter 230 to a downstream side, into the hollow interior 242, and into the inlet opening 220 where it is then advanced through the recirculation pump assembly 34 back to the spray arm 54.

Referring to FIG. 6A, looking at the flow of liquid through the filter 230, during operation, the rotating filter 230 is rotated about the axis 216 in the counter-clockwise direction and liquid is drawn through the rotating filter 230 from the upstream surface 246 to the downstream surface 248 by the rotation of the impeller 104. The rotation of the filter 230 in the counter-clockwise direction causes the mixture 250 of fluid and soil particles within the filter chamber 282 to rotate about the axis 216 in the direction indicated by the arrow 218. As the mixture 250 is rotated, the liquid advances through the gap 288 formed between the filter 230 and the artificial boundary 280 and is then in the increased shear force zone 294, which is created by liquid passing between the first artificial boundary 280 and the rotating filter 230.

The increased shear force zone 294 is formed by the significant increase in angular velocity of the liquid in the relatively short distance between the first artificial boundary 280 and the rotating filter 230 as was described with respect the first embodiment above. The increase in the angular speed of the liquid is illustrated as increasing length arrows in FIG. 6B, the longer the arrow length the faster the speed of the liquid. The proximity of the tip 283 to the rotating filter 230 causes an increase in the angular velocity of the liquid portion 290 and results in a shear force being applied on the upstream surface 246. This applied shear force aids in the removal of soils on the upstream surface 246 and is attributable to the interaction of the liquid portion 290 and the rotating filter 230. The increased shear zone 294 functions to remove and/or prevent soils from being trapped on the upstream surface 246. The shear force created by the increased angular acceleration and applied to the upstream surface 246 has a magnitude that is greater than what would be applied if the first artificial boundary 280 were not present. A similar increase in shear force occurs on the downstream surface 248 where the second artificial boundary 260 overlies the downstream surface 248. The liquid would have an angular speed profile of zero at the second artificial boundary 260 and would increase to approximately 3000 rpm at the downstream surface 248, which generates the increased shear forces.

As the tip 283 extends towards the upstream surface 246, the distance between the first artificial boundary 280 and the upstream surface 246 decreases. This decrease in distance between the first artificial boundary 280 and the upstream surface 246 occurs in a direction along a rotational direction of the filter 230, which in this embodiment, is counter-clockwise as indicated by arrow 218, and forms a constriction point at the tip 283. The distance between the first artificial boundary 280 and the upstream surface 246 increases from the tip 283 in a direction along the rotational direction of the filter 230 to form a liquid expansion zone 289.

Further, a nozzle or jet-like flow through the rotating filter 230 is provided to further clean the rotating filter 230 and is formed by at least one of high pressure zones 291, 293 and lower pressure zones 289, 292 on one of the upstream surface 246 and downstream surface 248. High pressure zone 293 is formed by the decrease in the gap 288 between the first artificial boundary 280 and the rotating filter 230, which functions to create a localized and increasing pressure gradient up to the tip 283, beyond which the liquid is free to expand to form the low pressure, expansion zone 289. Similarly, a high pressure zone 291 is formed between the downstream surface 248 and the second artificial boundary 260. The high pressure zone 291 is relatively constant until it terminates at the end of the second artificial boundary 260, where the liquid is free to expand and form the low pressure, expansion zone 292.

The high pressure zone 293 is generally opposed by the high pressure zone 291 until the end of the high pressure zone 291, which is short of the constriction point 289. At this point and up to the constriction point 289, the high pressure zone 293 forms a pressure gradient across the rotating filter 230 to generate a flow of liquid through the rotating filter 230 from the upstream surface 246 to the downstream surface 248. The pressure gradient is great enough that the flow has a nozzle or jet-like effect and helps to remove particles from the rotating filter 230. The presence of the low pressure expansion zone 292 opposite the high pressure zone 293 in this area further increases the pressure gradient and the nozzle or jet-like effect. The pressure gradient is great enough at this location to accelerate the water to an angular velocity greater than the rotating filter.

Figure 7:
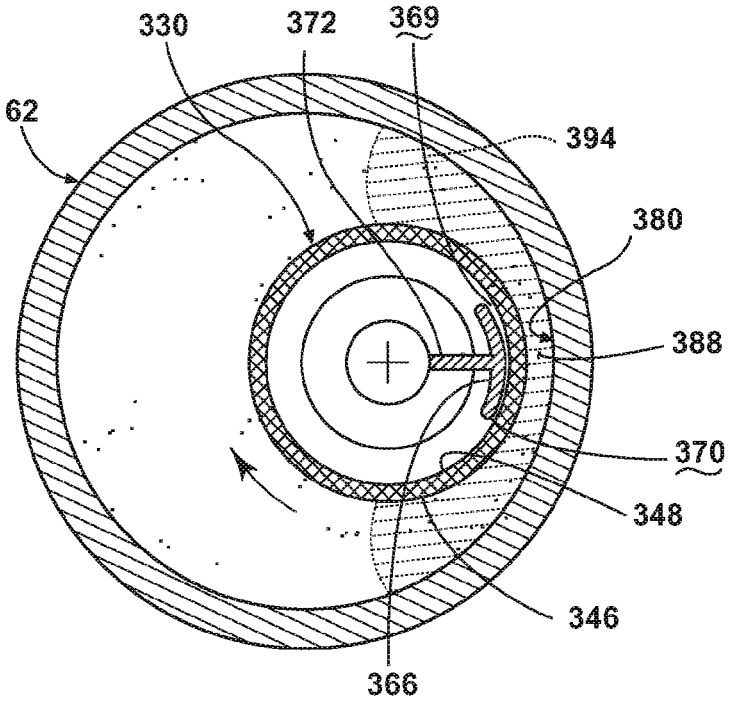
FIG. 7 is a cross-sectional elevation view illustrating a third embodiment of the rotary filter assembly.

FIG. 7 illustrates a third embodiment wherein the filter 330 is asymmetrically located within the housing 62, which positions a portion of the housing close enough to the filter to generate a shear zone 394. More specifically, the housing 62 is illustrated as defining a chamber that is cylindrical and has a central axis on which a geometric center lies and the rotating filter 330 is asymmetrically located within the chamber relative to the geometric center. As illustrated, the filter 330 may include a cylinder having a central axis, which may define a rotational axis for the rotating filter 330, and the central axis does not pass through the geometric center. Such a configuration turns the portion of the housing 62 into an artificial boundary 380. As discussed above, mere asymmetric positioning is not necessarily enough to provide a shear zone 394. It will be necessary for the housing 62 to be close enough to the filter 330 to generate the desired shear forces for the asymmetric position to result in the housing 62 functional as an artificial boundary.

As illustrated, the filter rotates in the clockwise direction and creates an increased shear force zone 394 between the artificial boundary 380 and the upstream surface 346. During operation, the liquid passing between the artificial boundary 380 and the rotating filter 330 applies a greater shear force on the upstream surface 346 than liquid in an absence of the artificial boundary 380 (i.e. in the absence of the filter 330 being offset within the housing 62).

Figure 8:
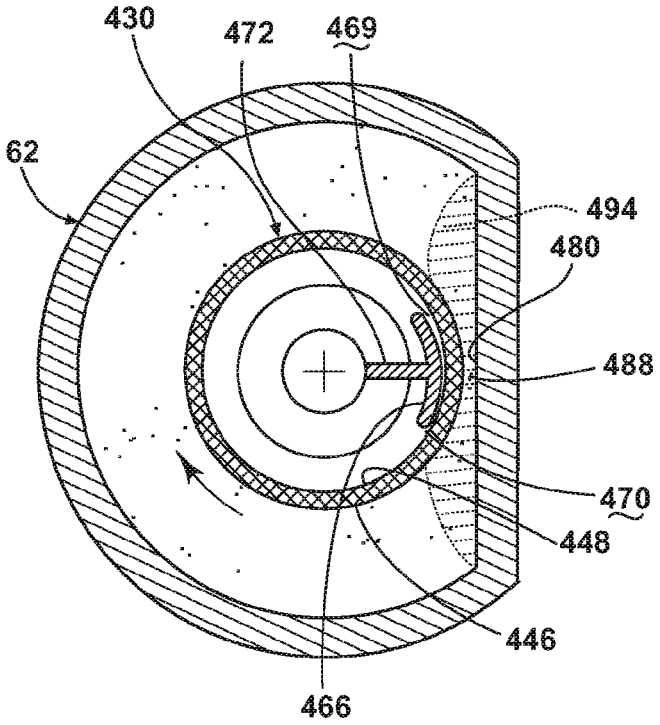
FIG. 8 is a cross-sectional elevation view illustrating a fourth embodiment of the rotary filter assembly.

FIG. 8 illustrates a fourth embodiment wherein the housing 62 is cylindrical except for a portion of the housing is flattened and is closer to the filter 430 than the remaining portions of the housing 62 and acts to form an artificial boundary 480 that creates an increased shear force zone 494 between the artificial boundary 480 and the upstream surface 446. During operation, the liquid passing between the artificial boundary 480 and the rotating filter 430 applies a greater shear force on the upstream surface 446 than liquid in an absence of the artificial boundary 480 (i.e. if the housing 62 were totally cylindrical).

With respect to all of the above embodiments it is contemplated that there may be multiple artificial boundaries spaced about the rotating filter and overlying the upstream surface to define multiple increased shear force zones. Further, there may be multiple artificial boundaries provided on the downstream of the rotating filter as well. The multiple artificial boundaries may be arranged in pairs, with each pair having one artificial boundary on the downstream side of the rotating filter and another artificial boundary on the upstream side of the rotating filter. Such multiple artificial boundaries may create multiple shear force zones as described above.

There are a plurality of advantages of the present disclosure arising from the various features of the method, apparatuses, and system described herein. For example, the embodiments of the apparatus described above allows for enhanced filtration such that soil is filtered from the liquid and not re-deposited on utensils. Further, the embodiments of the apparatus described above allow for cleaning of the filter throughout the life of the dishwasher and this maximizes the performance of the dishwasher. Thus, such embodiments require less user maintenance than required by typical dishwashers.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a tub at least partially defining a washing chamber;

a liquid spraying system supplying a spray of liquid to the washing chamber;

a liquid recirculation system recirculating the sprayed liquid from the washing chamber to the liquid spraying system to define a recirculation flow path; and a liquid filtering system comprising:

a housing defining a cylindrical chamber that has a first central axis that defines a geometric center and having an inlet and an outlet, with the recirculation flow path passing from the inlet of the housing to the outlet of the housing; and a rotating filter comprising a cylinder having a second central axis and enclosing a hollow interior and having an upstream surface and a downstream surface, the rotating filter located relative to the inlet of the housing and the outlet of the housing such that the recirculation flow path passes through the rotating filter from the upstream surface to the downstream surface to effect a filtering of the sprayed liquid wherein the rotating filter is asymmetrically located within the chamber relative to the geometric center and the second central axis of the rotating filter does not pass through the geometric center;

wherein during recirculation the housing is configured to be filled with liquid and the rotating filter is submerged within the liquid, the second central axis of the rotating filter defines a rotational axis for the rotating filter and the rotating filter is configured to create a rotational flow of unfiltered liquid within the housing circumferentially about the upstream surface of the rotating filter and a portion of the rotating filter is positioned closer to a portion of the housing than a remainder of the rotating filter and the portion of the filter and the portion of the housing create an increase in angular velocity of the liquid therebetween to form an increased shear force zone therebetween greater than the shear force created by the housing over a remainder of the rotating filter.

2. The dishwasher of claim 1, further comprising an artificial boundary overlying the downstream surface of the rotating filter to form an increased shear force zone between the artificial boundary and the downstream surface of the rotating filter.

3. The dishwasher of claim 2, further comprising a beam positioned in the hollow interior, wherein the artificial boundary is coupled to a portion of the beam.

4. The dishwasher of claim 1 wherein the rotating filter further comprises a porous sheet forming at least a portion of the cylinder.

5. The dishwasher of claim 4 wherein the porous sheet is a sheet of chemically etched metal.

6. The dishwasher of claim 1 wherein the liquid recirculation system includes a wash pump in fluid communication with the hollow interior, the wash pump being operable to draw fluid through the rotating filter into the hollow interior.

7. The dishwasher of claim 1, further comprising a drain pump coupled to the housing and wherein the drain pump is operable to remove fluid from the housing.

* * * * *